US007325761B2

(12) United States Patent
Chen et al.

(10) Patent No.: US 7,325,761 B2
(45) Date of Patent: Feb. 5, 2008

(54) HAMMER FOR A MATERIAL SIZE REDUCTION MACHINE

(75) Inventors: Michael Ming-Ming Chen, Naperville, IL (US); Jianrong Chen, Naperville, IL (US); David Michael Podmokly, Downers Grove, IL (US)

(73) Assignee: ALSTOM Technology Ltd (CH)

( * ) Notice: Subject to any disclaimer, the term of this patent is extended or adjusted under 35 U.S.C. 154(b) by 540 days.

(21) Appl. No.: 10/847,958

(22) Filed: May 18, 2004

(65) Prior Publication Data

US 2005/0258289 A1 Nov. 24, 2005

(51) Int. Cl.
*B02C 13/00* (2006.01)

(52) U.S. Cl. ..... 241/194; 241/195

(58) Field of Classification Search ..... 241/195, 241/191, 194, 185.5, 190
See application file for complete search history.

(56) References Cited

U.S. PATENT DOCUMENTS 858,772 A * 7/1907 Williams ..... 241/189.1
906,346 A * 12/1908 Williams ..... 241/194
1,132,047 A * 3/1915 Thompson ..... 241/86.2
1,753,474 A * 4/1930 Polster ..... 241/135
2,045,690 A * 6/1936 Armstrong ..... 241/194
2,331,597 A * 10/1943 Coles ..... 241/194
2,803,634 A * 8/1957 Chayen ..... 554/23
2,939,638 A * 6/1960 Haigh et al. ..... 241/52
3,261,151 A * 7/1966 Myers et al. ..... 56/294
3,482,789 A * 12/1969 Newell ..... 241/195
3,486,704 A * 12/1969 Persky ..... 241/167
5,529,249 A * 6/1996 Braun et al. ..... 241/32

* cited by examiner

*Primary Examiner*—Bena Miller
(74) *Attorney, Agent, or Firm*—Timothy J. Olson

(57) ABSTRACT

A hammer 28 is provided for a material size-reducing machine of the type including a rotor on which the hammer is individually pivotally mounted. The hammer 28 includes a mounting end 36 having a throughbore for receiving a pivot pin therethrough in connection with the pivot mounting of the hammer on the rotor, an extending portion 40 with the center of mass CGM located therein. The extending portion has a non-linear body portion 44 and a linear body portion 46 with the linear body portion 46 being inclined in a direction opposite to the rotation direction at an angle between 5 to 45 degrees as measured relative to a line RFL extending through the center of the pivot pin and the center of mass CGM of the hammer.

6 Claims, 4 Drawing Sheets

HAMMER FOR A MATERIAL SIZE REDUCTION MACHINE

BACKGROUND OF THE INVENTION

The invention relates to a hammer for a material size reduction machine.

Typically, in conventional hammer mills, a large number of hammers are individually pivotally mounted on a rotating drum or disk rotating at high speed. The hammers are rotated at high speed and sweep adjacent the inner circumferential wall of a mill housing, whereupon particles to be size reduced are fed into the mill and collide with the front faces of the hammers.

To achieve a desired high output, and because of the wide variety of materials that must be processed by these material size reducing machines, the hammer mills or rotors must be very heavily constructed to provide the necessary strength for effective operation and durability. Additionally, a heavy hammer mill or rotor will also have a large amount of angular momentum and energy to effectively process tough, high strength materials and also maintain a relatively constant rotational speed, resulting in less wear on the drive train and engine.

Dimensional constraints and the severity of operating conditions must be considered with respect to the construction and configuration of a hammer. The hammers are typically pivotally mounted to the periphery of a rotating drum or disk. One problem associated with such machines is the regular need to replace damaged or worn hammers, this need being engendered by the high rates of rotation and the impact energies associated with the contact of the hammers with the particulate material to be size reduced.

Attempts have been made to improve the durability of such hammers by, for example, hardening of contact surfaces of the hammer. However, the need still exists for a hammer that offers a more favorable impact wear characteristic Accordingly, it is an object of the present invention to provide a hammer that addresses the concerns set forth above.

SUMMARY OF THE INVENTION

According to the present invention, a hammer is provided for a material size reducing machine of the type including a rotor on which the hammer is individually pivotally mounted, whereupon the inventive hammer advantageously offers a more favorable impact wear characteristic. The inventive hammer advantageously provides a higher grinding efficiency because of a) stronger secondary breakage by the shortened particle-traveling distance and higher particle velocity hitting the liner wall and b) a separate deflected particle passage that permits the hammer to transfer energy to the incoming particles more efficiently. Moreover, the inventive hammer offers the possibility of uniform wear, so as to provide a longer service life and to maintain a sustained peak performance.

According to one aspect of the present invention, the inventive hammer includes a mounting end having a throughbore for receiving a pivot pin therethrough in connection with the pivot mounting of the hammer on the rotor, whereupon the axis of the pivot pin when mounted through the throughbore extends parallel to the axis of rotation of the rotor. The hammer includes an extending portion extending from the mounting end and terminating in a distal end with the center of mass of the hammer being located in the extending portion.

According to a further detail of the one aspect of the present invention, the extending portion has a non-linear body portion and a linear body portion with the non-linear body portion being located intermediate the linear body portion and the throughbore.

According to yet another detail of the one aspect of the present invention, the linear body portion is inclined in a direction opposite to the rotation direction of the rotor at an angle between 5 to 45 degrees as measured relative to a line extending through the center of the pivot pin and the center of mass of the hammer.

DETAILED DESCRIPTIONS OF THE PREFERRED EMBODIMENTS

Figure 1:
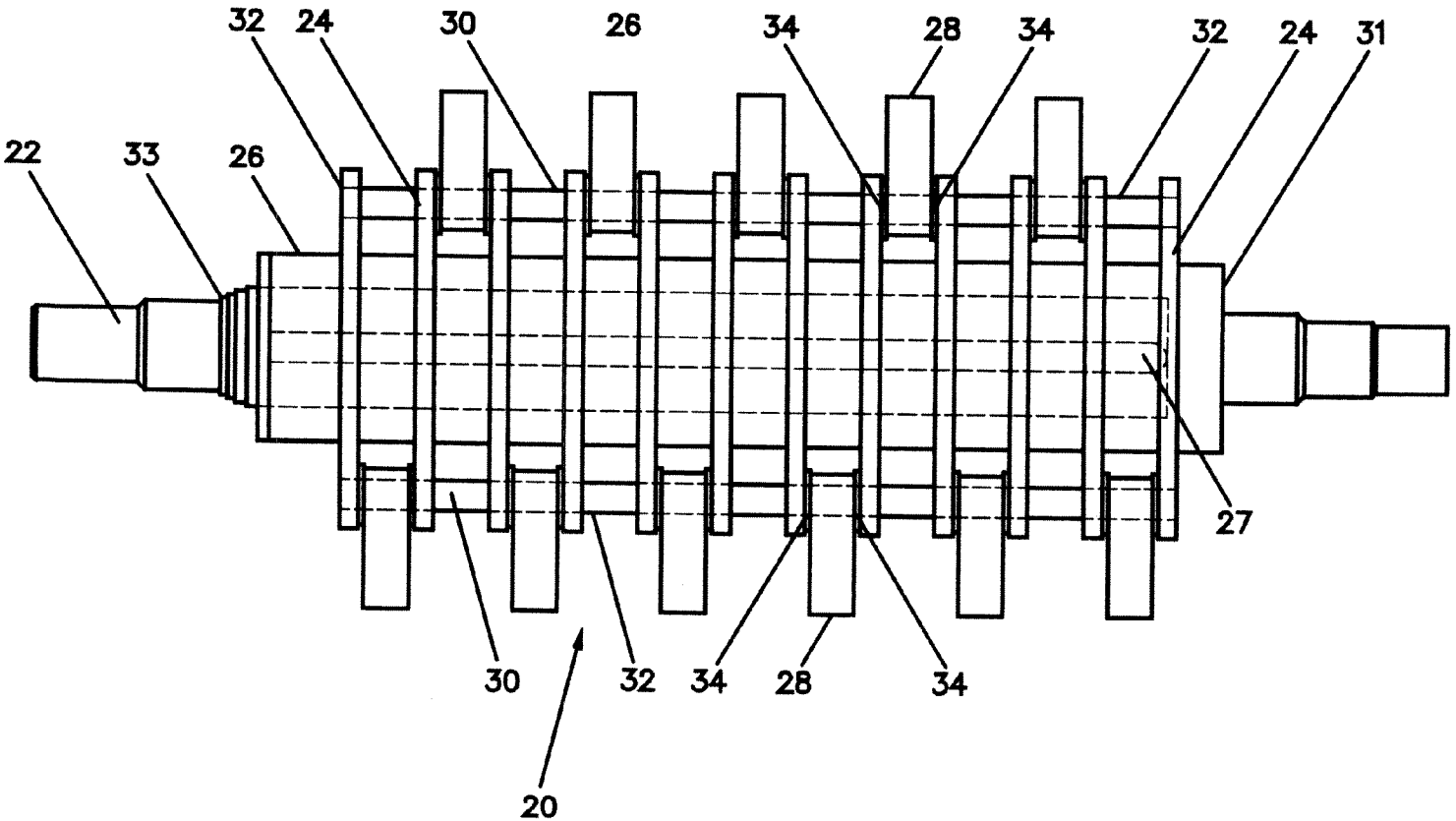
Figure 1 Prior Art
FIG. 1 is a front elevational view of a portion of a conventional hammermill that is representative of the type of material size reducing machine on which the hammer of the present invention can be mounted.

Referring now to the drawings, FIG. 1 illustrates a conventional hammermill suitable for use with the hammer of the present invention. This conventional hammermill is illustrated and described in U.S. Pat. No. 5,507,441, wherein, in that FIG. 1 of that patent and as illustrated in FIG. 1 herein, there is illustrated a hammermill 20 having a main shaft 22 which is rotated about a longitudinal axis by conventional driving mechanisms such as gas or electric powered motors. Mounted in longitudinally spaced relation along the shaft 22 are a plurality of plates 24. Associated with the plates 24 are a plurality of hubs 26 for maintaining spacing of the plates 24 along the shaft 22. The plates 24 each have keyways which mate with a longitudinally extended key 27 formed by the main shaft 22 for preventing relative rotation between the shaft 22 and the plates 24. The plates 24 and hubs 26 are prevented from moving longitudinally along the main shaft 22 by an end plate 31 rigidly connected to one end of the main shaft 22 and a nut 33 threaded onto the other end of the main shaft 22 such that the plates 24 and associated hubs 26 are compressed between the end plate 31 and the nut 33.

A plurality of free-swinging hammers 28 are pivotally mounted between the plates 24 along pivot axes parallel to and spaced from the main axis. The free-swinging hammers 28 are pivotally mounted on pivot pins 30 that are aligned along the pivot axes. The pivot pins 30 extend through linearly aligned holes 32 defined by the plates 24 at locations proximate the outer circumference of the plates 24. The hammers 28 are free to pivot about their corresponding pivot pins 30 within the area of motion defined by contact of the hammers 28 with the main shaft 22. The plates 24 are rotated by the main shaft 22 in a direction of rotation PDR (a clockwise direction out of the plane of the illustration of the hammermill 20 shown in FIG. 1).

Figure 2:
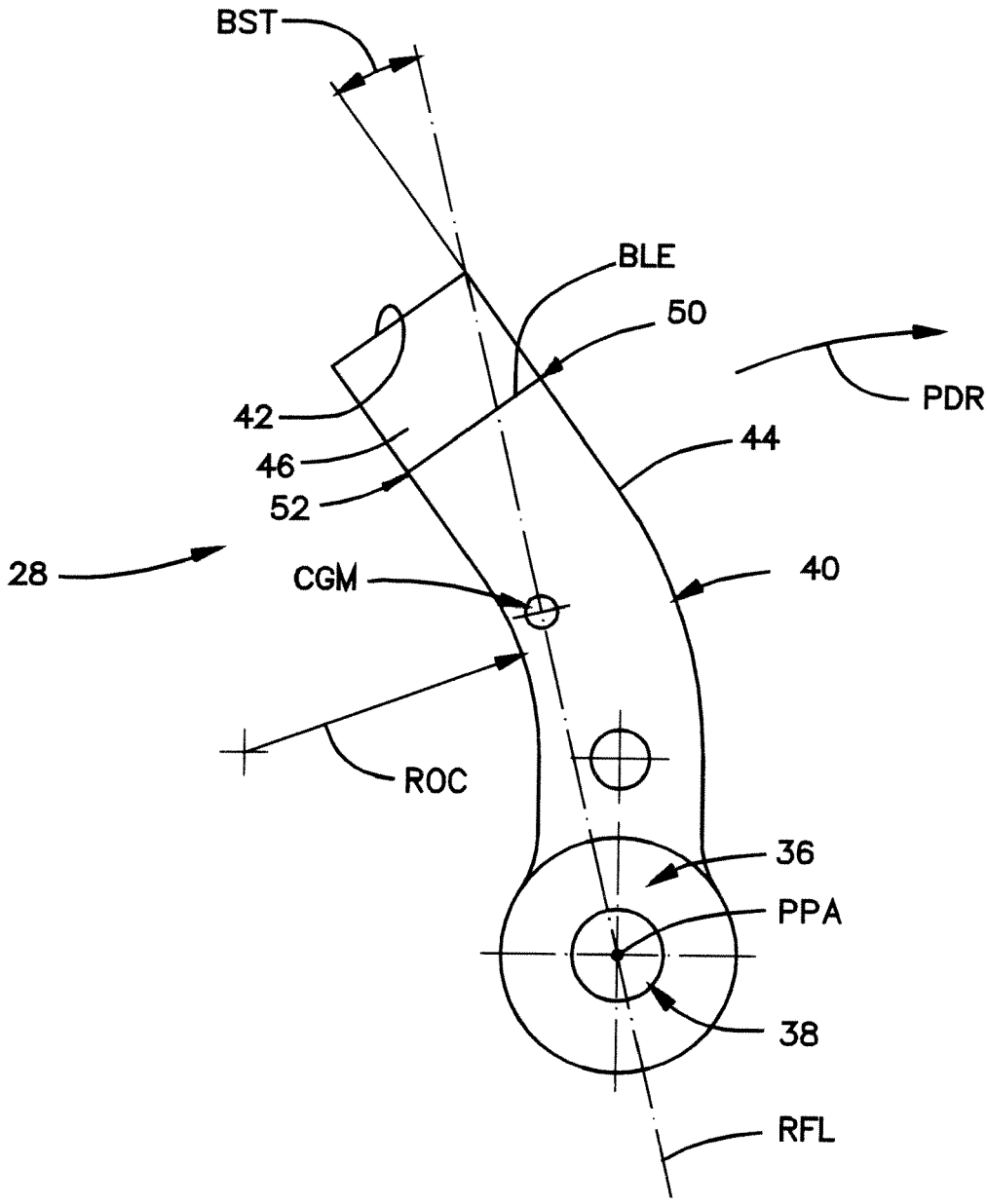
FIG. 2 is an enlarged side elevational view of one embodiment of the hammer of present invention.
Figure 3:
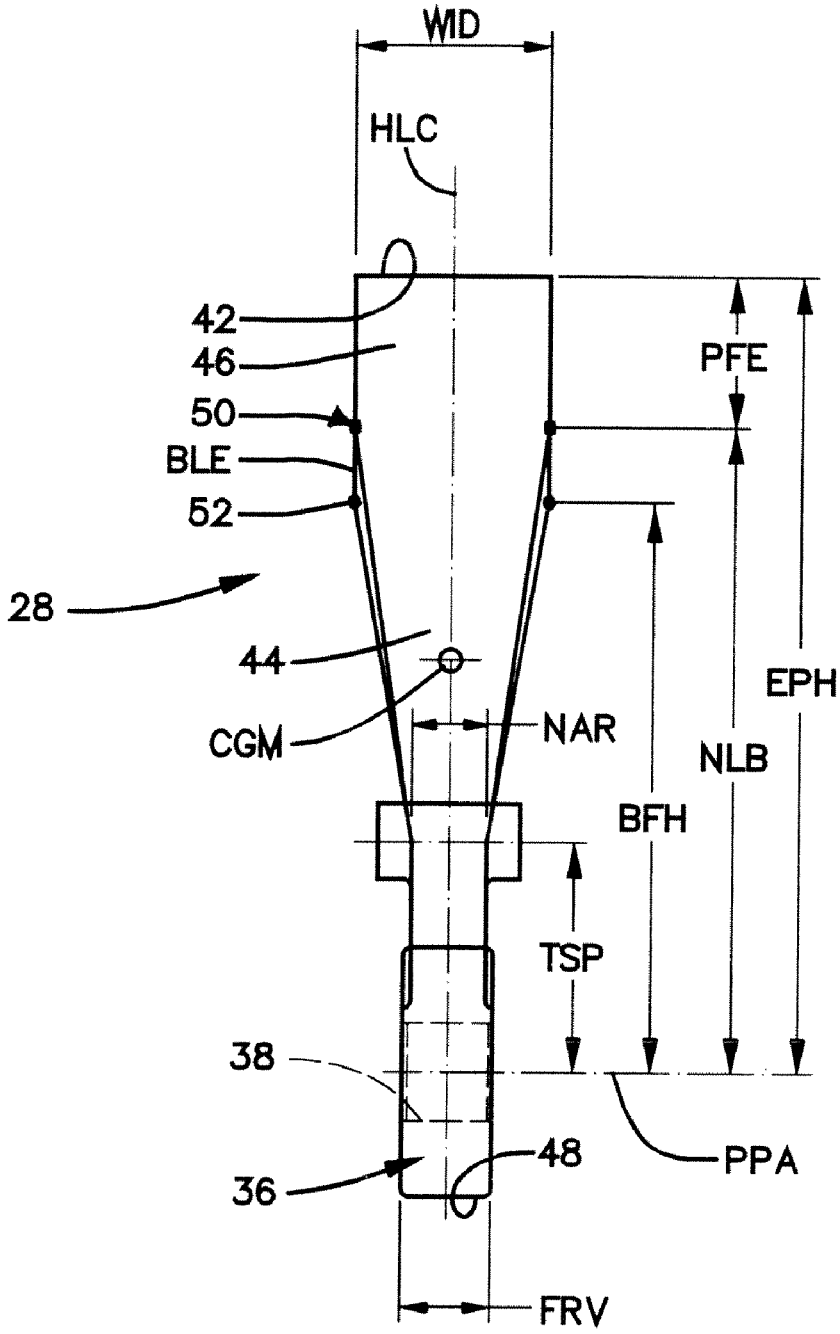
FIG. 3 is a front elevational view of the one embodiment of the hammer shown in FIG. 2.

A more detailed description of the hammers 28 will now be had with reference to FIG. 2, which is an enlarged side elevational view of one embodiment of the hammer of present invention, and FIG. 3, which is a front elevational view of the one embodiment of the hammer shown in FIG. 2. The hammer 28 includes a mounting end 36 having a throughbore 38 for receiving one of the pivot pins 30 therethrough in connection with the pivot mounting of the hammer between a respective adjacent pair of the plates 24. The axis PPA of the pivot pin 30 when mounted through the throughbore 38 extends parallel to the axis of rotation of the plates 24.

The hammer 28 also includes an extending portion 40 extending from the mounting end 36 and terminating in a distal end 42 with the center of mass CGM of the hammer being located in the extending portion 40. The extending portion 40 has a non-linear body portion 44 and a linear body portion 46 with the non-linear body portion 44 being located intermediate the linear body portion 46 and the throughbore 38. The linear body portion 46 is inclined in a direction opposite to the rotation direction PDR of the plates 24 at a backset angle BST between five to forty-five degrees (5 to 45°) as measured relative to a reference line RFL extending through the center of the pivot pin 30 and the center of mass CGM of the hammer. The backset angle BST is most preferably between fifteen to twenty-five degrees (15 to 25°) as measured relative to the reference line RFL.

With reference to FIG. 3, it can be seen that the linear body portion 46 of the extending portion 40 of the hammer 28 has a planar face having height extent PFE, as measured radially to the pivot pin axis PPA from the distal end 42 to the topmost edge of the non-linear body portion 44, is 10 to 50% of the height extent EPH of the extending portion 40, as measured radially to the pivot pin axis PPA from the distal end 42 to the pivot pin axis PPA. The non-linear body portion 44 has a height extent NLB as measured radially to the pivot pin axis PPA from the bottom most edge of the linear body portion 46 of 50 to 90% of the height extent EPH of the extending portion 40 with the respective height extent NLB of the non-linear body portion 44 and the respective height extent EPH of the linear body portion 46 together comprising the height extent EPH of the extending portion 40, as measured radially to the pivot pin axis PPA from the distal end 42 to the pivot pin axis PPA.

The hammer 28 has a width extent WID at the distal end 42 as measured parallel to the pivot pin axis PPA. The width extent of the hammer 28 tapers symmetrically inwardly from both sides of the non-linear body portion 44 toward a longitudinal centerline HLC of the hammer 28 from the width extent WID to its most narrow width extent NAR, which is located at a height TSP above the pivot pin axis PPA of between 20 to 70% of the height extent EPH of the extending portion 40. Both the width extent WID of the hammer 28 at its distal end 42 and the most narrow width extent NAR of the hammer 28 are centered on the longitudinal centerline HLC. The balance of the hammer 28 from the bottom most edge of the non-linear body portion 44 to its most narrow width extent NAR to its inside end 48 has a maximum width extent FRV that can be equal to the most narrow width extent NAR of the non-linear body portion 44 or slightly larger but less than the width extent WID of the linear body portion 46.

With reference again to FIG. 2, it can be seen that the linear body portion 46 of the extending portion 40 of the hammer 28 is rectilinear with the faces thereof defining its width extent WID being at right angles to the faces thereof defining its height extent PFE, and these faces, in turn, being at right angles to the depth extent of the linear body portion 46 as measured along a bottom most side edge BLE of the linear body portion 46. Thus, the distal end 42 formed by the top of the linear body portion 46 is planar and the bottom most side edges BLE of the linear body portion 46 are parallel to the distal end 42 Each bottom most side edge BLE of the linear body portion 46 thus extends at a downward incline as viewed from the right to the left in FIG. 2 from its front face terminus 50 at the front face of the hammer 28 (i.e., the respective face of the hammer 28 that contacts the material to be milled) to its back face terminus 52 at the back face of the hammer 28. The front face terminus 50 of each bottom most side edge BLE of the linear body portion 46 is at a front face height defined by the height extent NLB of the non-linear body portion 44 that is greater than the back face height BFH of the back face terminus 52. As seen in FIG. 2, the non-linear body portion 44 of the extending portion 40 of the hammer 28 has a radius of curvature ROC of between ten to sixty degrees (10 to 60°).

Figure 4:
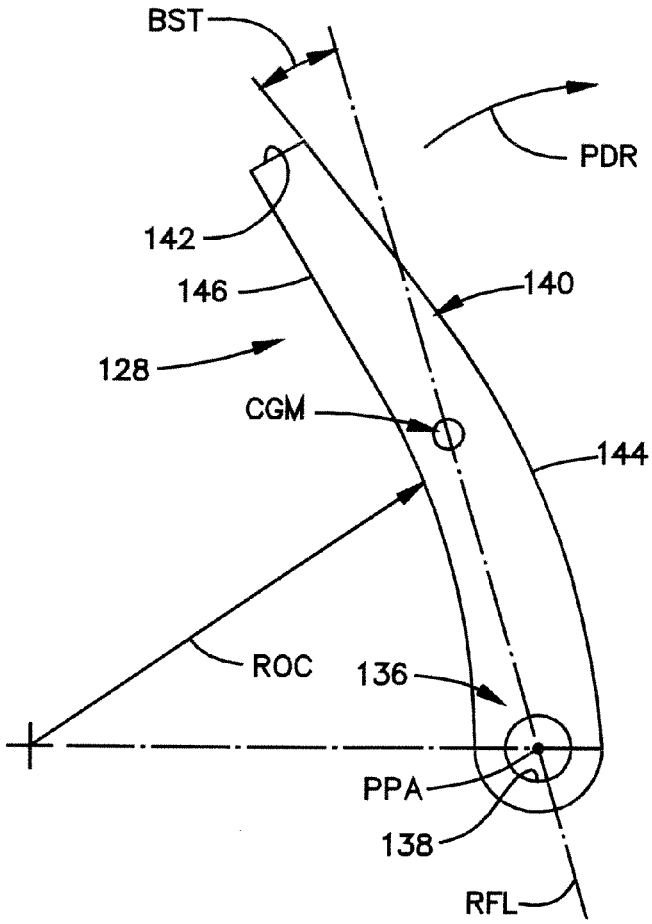
FIG. 4 is an enlarged side elevational view of another embodiment of the hammer of present invention.
Figure 5:
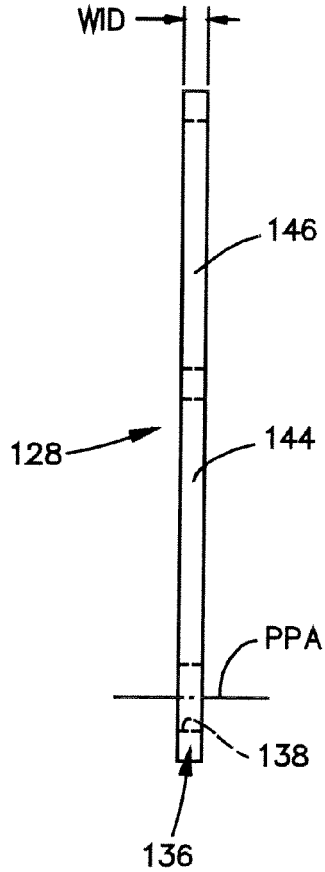
FIG. 5 is a front elevational view of the another embodiment of the hammer shown in FIG. 4.

A more detailed description of another embodiment of the hammer of the present invention will now be had with reference to FIG. 4, which is an enlarged side elevational view of this other embodiment of the hammer of the present invention, and FIG. 5, which is a front elevational view of the embodiment of the hammer shown in FIG. 4. The hammer in the embodiment shown in FIGS. 4 and 5, hereinafter designated the hammer 128, includes a mounting end 136 having a throughbore 138 for receiving one of the pivot pins 30 therethrough in connection with the pivot mounting of the hammer between a respective adjacent pair of the plates 24. The axis PPA of the pivot pin 30 when mounted through the throughbore 138 extends parallel to the axis of rotation of the plates 24.

The hammer 128 also includes an extending portion 140 extending from the mounting end 136 and terminating in a distal end 142 with the center of mass CGM of the hammer being located in the extending portion 140. The extending portion 140 has a non-linear body portion 144 and a linear body portion 146 with the non-linear body portion 144 being located intermediate the linear body portion 146 and the throughbore 138. The linear body portion 146 is inclined in a direction opposite to the rotation direction PDR of the plates 24 at a backset angle BST between five to forty-five degrees (5 to 45°) as measured relative to a reference line RFL extending through the center of the pivot pin 30 and the center of mass CGM of the hammer. The backset angle BST is most preferably between fifteen to twenty-five degrees (15 to 25°) as measured relative to the reference line RFL.

With reference to FIG. 5, it can be seen that the linear body portion 146 and the non-linear body portion 144 of the extending portion 140 of the hammer 128 together comprise the height extent of the extending portion 140, as measured radially to the pivot pin axis PPA from the distal end 142 to the pivot pin axis PPA. The non-linear body portion 144 of the extending portion 140 of the hammer 128 has a radius of curvature ROC of between ten to sixty degrees (10 to 60°). The hammer 128 has a width extent WID at the distal end 142 as measured parallel to the pivot pin axis PPA. The width extent WID of the hammer 128 is the same along the entire extents of the linear body portion 146 and the non-linear body portion 144.

Since the invention is susceptible to various modifications and alternative forms, it should be understood that the invention is not intended to be limited to the particular forms disclosed. Rather, the scope of the invention extends to all modifications, equivalents and alternatives falling within the spirit and scope of the invention as defined by the appended claims.

What is claimed is:

1. A hammer for a material size reducing machine, the material size reducing machine including a rotor on which a plurality of hammers are individually pivotally mounted, the hammer comprising:

a mounting end having a throughbore for receiving a pivot pin therethrough in connection with the pivot mounting of the hammer on the rotor, whereupon the axis of the pivot pin when mounted through the throughbore extends parallel to the axis of rotation of the rotor;

an extending portion extending from the mounting end and terminating in a distal end with the center of mass of the hammer being located in the extending portion and having a height extent measured radially from the pivot pin axis to the distal end of the extending portion;

the extending portion having a non-linear body portion and a linear portion;

the non-linear body portion being located intermediate the linear body portion and the throughbore;

the linear body portion being inclined in a direction opposite to the direction of rotation of the rotor as measured relative to a line extending through the center of the pivot pin and the center of mass of the hammer;

the non-linear body portion having a height extent measured from the pivot pin axis to the bottom most edge of the linear body portion of 50% to 90% of the height extent of the extending portion; and the linear body portion having a planar face and having a height extent measured from the distal end to the top most edge of the non-linear body portion of 10% to 50% of the height extent of the extending portion.

2. A hammer according to claim 1, wherein the non-linear body portion of the extending portion of the hammer has a radius of curvature of between ten to sixty degrees (10 to 60°).

3. A hammer according to claim 1, wherein the linear body portion of the extending portion of the hammer is rectilinear.

4. A hammer according to claim 1, wherein the non-linear body portion has a width extent that from the bottom most edge of the linear body portion to the pivot pin axis tapers symmetrically inwardly from both sides of the non-linear body portion.

5. A hammer according to claim 4, wherein the width extent of the linear body portion and the non-linear body portion are the same along the entire extent of the hammer.

6. A hammer according to claim 4, wherein the width extent of the non-linear body portion is narrowest at a height above the pivot pin axis of between 20% to 70% of the height extent of the extending portion of the hammer.

* * * * *